US011373582B2

(12) United States Patent
Lee et al.

(10) Patent No.: US 11,373,582 B2
(45) Date of Patent: Jun. 28, 2022

(54) PIXEL CIRCUIT AND DRIVING METHOD THEREOF, DISPLAY PANEL

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Sang Won Lee, Beijing (CN); Yidan Zhu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 363 days.

(21) Appl. No.: 16/492,676

(22) PCT Filed: Feb. 15, 2019

(86) PCT No.: PCT/CN2019/075239
§ 371 (c)(1),
(2) Date: Sep. 10, 2019

(87) PCT Pub. No.: WO2019/233120
PCT Pub. Date: Dec. 12, 2019

(65) Prior Publication Data

US 2021/0366363 A1 Nov. 25, 2021

(30) Foreign Application Priority Data

Jun. 8, 2018 (CN) ..... 201810588684.X

(51) Int. Cl.
*G09G 3/32* (2016.01)
*G09G 3/20* (2006.01)

(52) U.S. Cl.
CPC ..... *G09G 3/32* (2013.01); *G09G 3/2092* (2013.01); *G09G 2300/0426* (2013.01);
(Continued)

(58) Field of Classification Search
CPC ..... G09G 3/32; G09G 3/2092; G09G 2300/0426; G09G 2310/027;
(Continued)

(56) References Cited

U.S. PATENT DOCUMENTS 9,646,539 B2 5/2017 Eom
2017/0263187 A1 9/2017 Zhu et al.
(Continued)

FOREIGN PATENT DOCUMENTS

CN 104851386 A 8/2015
CN 105575327 A 5/2016
(Continued)

*Primary Examiner* — Andrew Sasinowski
(74) *Attorney, Agent, or Firm* — Dilworth & Barrese, LLP.; Michael J. Musella, Esq.

(57) ABSTRACT

A pixel circuit, a method of driving a pixel circuit and a display panel. The pixel circuit includes: a drive circuit, a data writing circuit, a compensation circuit, and a light emitting element. The drive circuit includes a control terminal, a first terminal and a second terminal, and is configured to control a drive current flowing through the first terminal and the second terminal for driving the light emitting element to emit light. The data writing circuit is configured to write a data signal to a first terminal of the drive circuit in response to a first scanning signal. The compensation circuit stores a data signal written by the data writing circuit and compensates the drive circuit in response to a second scanning signal. A first terminal of the light emitting element receives a drive current, and a second terminal thereof is connected to a second voltage terminal.

20 Claims, 6 Drawing Sheets

(52) U.S. Cl.
CPC ..... *G09G 2310/027* (2013.01); *G09G 2310/0278* (2013.01); *G09G 2310/0294* (2013.01); *G09G 2310/061* (2013.01)

(58) Field of Classification Search
CPC ... G09G 2310/0278; G09G 2310/0294; G09G 2310/061
See application file for complete search history.

(56) References Cited

U.S. PATENT DOCUMENTS

| | | | | |
|---|---|---|---|---|
| 2017/0270869 | A1* | 9/2017 | Ma | G09G 3/3266 |
| 2018/0190185 | A1 | 7/2018 | Ko et al. | |

FOREIGN PATENT DOCUMENTS

| | | | |
|---|---|---|---|
| CN | 105679236 | A | 6/2016 |
| CN | 106531075 | A | 3/2017 |
| CN | 107945743 | A | 4/2018 |
| CN | 107564468 | A | 1/2019 |
| CN | 109509427 | A | 3/2019 |
| EP | 3264408 | A2 | 1/2018 |
| KR | 1020050116206 | A | 12/2005 |

* cited by examiner

PIXEL CIRCUIT AND DRIVING METHOD THEREOF, DISPLAY PANEL

The present application is based on International application No. PCT/CN2019/075239, filed on Feb. 15, 2019, which claims priority of the Chinese Patent Application No. 201810588684.X, filed on Jun. 8, 2018, the entire disclosure of which is incorporated herein by reference as part of the present application.

TECHNICAL FIELD

Embodiments of the present invention relates to a pixel circuit and driving method thereof and a display panel.

BACKGROUND

An organic light emitting diode (OLED) display device has gradually attracted widespread attention due to its advantages of wide viewing angle, high contrast, fast response speed, as well as higher luminous brightness and lower driving voltage relative to an inorganic light emitting display device. Due to the above characteristics, organic light emitting diodes (OLED) may be applied to devices with a display function such as mobile phones, displays, notebook computers, digital cameras, instruments and meters, etc.

Pixel circuits in OLED display devices generally adopt a matrix driving mode, and are classified as active matrix (AM) driving and passive matrix (PM) driving depending on whether a switching element is introduced into each pixel unit. Although PMOLED has a simple process and a low cost, it cannot meet the requirements of high resolution and large size display due to its shortcomings of cross talk, high power consumption and short lifetime. In contrast, AMOLED integrates a set of thin film transistors and storage capacitors in the pixel circuit of each pixel. Through a drive control of the thin film transistors and the storage capacitors, a current flowing through the OLED is controlled, so that the OLED emits light as required. Compared with the PMOLED, the AMOLED requires less drive current and lower power consumption, and has longer lifetime, which may meet the large-size display requirements of high-resolution and multi-gray-gradation. Meanwhile, the AMOLED has obvious advantages in visual angle, color restoration, power consumption and response time etc., and is applicable for display devices with high information content and high resolution.

SUMMARY

At least one embodiment of the present disclosure provides a pixel circuit, which includes a drive circuit, a data writing circuit, a compensation circuit, and a light emitting element. The drive circuit includes a control terminal, a first terminal and a second terminal, and is configured to control a drive current flowing through the first terminal and the second terminal for driving the light emitting element to emit light. The data writing circuit is connected to a first terminal of the drive circuit and configured to write a data signal to the first terminal of the drive circuit in response to a first scanning signal. The compensation circuit is connected to a control terminal and a second terminal of the drive circuit and connected to a first voltage terminal, and is configured to store a data signal written by the data writing circuit and compensate the drive circuit in response to a second scanning signal. The light emitting element includes a first terminal and a second terminal, and a first terminal of the light emitting element is configured to receive the drive current, and a second terminal of the light emitting element is connected to a second voltage terminal.

For example, the pixel circuit provided by at least one embodiment of the present disclosure further includes a first light emitting control circuit. The first light emitting control circuit is connected to the first terminal of the drive circuit and the first voltage terminal, and is configured to apply a first voltage received from the first voltage terminal to the first terminal of the drive circuit in response to a first light emitting control signal.

For example, the pixel circuit provided by at least one embodiment of the present disclosure further includes a second light emitting control circuit. The second light emitting control circuit is connected to the second terminal of the drive circuit and the first terminal of the light emitting element, and is configured to apply the drive current to the light emitting element in response to a second light emitting control signal.

For example, the pixel circuit provided by at least one embodiment of the present disclosure further includes a reset circuit. The reset circuit is connected to a reset voltage terminal and the first terminal of the light emitting element, and is configured to apply a reset voltage received from the reset voltage terminal to the first terminal of the light emitting element in response to a reset signal, and the reset signal is the second scanning signal.

For example, in the pixel circuit provided by at least one embodiment of the present disclosure, the drive circuit includes a first transistor. A gate electrode of the first transistor serves as the control terminal of the drive circuit, a first electrode of the first transistor serves as the first terminal of the drive circuit, and a second electrode of the first transistor serves as the second terminal of the drive circuit.

For example, in the pixel circuit provided by at least one embodiment of the present disclosure, the data writing circuit includes a second transistor. A gate electrode of the second transistor is connected to a first scanning line for receiving the first scanning signal, a first electrode of the second transistor is connected to a data line for receiving the data signal, and a second electrode of the second transistor is connected to the first terminal of the drive circuit.

For example, in the pixel circuit provided by at least one embodiment of the present disclosure, the compensation circuit includes a third transistor and a capacitor. A gate electrode of the third transistor is connected to a second scanning line for receiving the second scanning signal, a first electrode of the third transistor is connected to the second terminal of the drive circuit, and a second electrode of the third transistor is connected to the control terminal of the drive circuit. And a first electrode of the capacitor is connected to the control terminal of the drive circuit, and a second electrode of the capacitor is connected to the first voltage terminal.

For example, in the pixel circuit provided by at least one embodiment of the present disclosure, the first light emitting control circuit includes a fourth transistor. A gate electrode of the fourth transistor is connected to a first light emitting control line for receiving the first light emitting control signal, a first electrode of the fourth transistor is connected to the first voltage terminal for receiving the first voltage, and a second electrode of the fourth transistor is connected to the first terminal of the drive circuit.

For example, in the pixel circuit provided by at least one embodiment of the present disclosure, the second light emitting control circuit includes a fifth transistor. A gate electrode of the fifth transistor is connected to a second light emitting control line for receiving the second light emitting control signal, a first electrode of the fifth transistor is connected to the second terminal of the drive circuit, and a second electrode of the fifth transistor is connected to the first terminal of the light emitting element.

For example, in the pixel circuit provided by at least one embodiment of the present disclosure, the reset circuit includes a sixth transistor. A gate electrode of the sixth transistor is connected to a second scanning line for receiving the second scanning signal as the reset signal, a first electrode of the sixth transistor is connected to the reset voltage terminal for receiving the reset voltage, and a second electrode of the sixth transistor is connected to the first terminal of the light emitting element.

For example, in the pixel circuit provided by at least one embodiment of the present disclosure, the third transistor and the sixth transistor are N-type transistors, and the first transistor, the second transistor, the fourth transistor and the fifth transistor are P-type transistors.

For example, in the pixel circuit provided by at least one embodiment of the present disclosure, a type of the transistor included in the compensation circuit is different from that of the transistor included in the drive circuit.

For example, in the pixel circuit provided by at least one embodiment of the present disclosure, the compensation circuit includes an N-type transistor and the drive circuit includes a P-type transistor.

For example, in the pixel circuit provided by at least one embodiment of the present disclosure, the compensation circuit and the reset circuit each include an N-type transistor, and the drive circuit, the data writing circuit, the first light emitting control circuit, and the second light emitting control circuit each include a P-type transistor.

At least one embodiment of the present disclosure further provides a display panel, which includes a plurality of pixel units arranged in an array, and each of the plurality of pixel units comprises the pixel circuit provided by any embodiment of the present disclosure.

For example, the display panel provided by at least one embodiment of the present disclosure further includes a plurality of light emitting control lines. The plurality of pixel units are arranged in a plurality of rows, and a second light emitting control circuit of a pixel circuit of pixel units in a nth row and a first light emitting control circuit of a pixel circuit of pixel units in a n+1st row are connected to a same light emitting control line, and n is an integer greater than zero.

At least one embodiment of the present disclosure further provides a driving method of the pixel circuit, which includes a data writing and compensation stage and a light emitting stage. In the data writing and compensation stage, the first scanning signal, the second scanning signal and the data signal are input to turn on the data writing circuit, the drive circuit and the compensation circuit, and the data writing circuit writes the data signal into the drive circuit, the compensation circuit stores the data signal, and the compensation circuit compensates the drive circuit. In the light emitting stage, the first light emitting control signal is input so as to turn on the first light emitting control circuit and the drive circuit, and the first light emitting control circuit applies the drive current to the light emitting element to make it emit light. And the first scanning signal and the second scanning signal are simultaneously on-signals within at least part of the above stages.

At least one embodiment of the present disclosure further provides a driving method of the pixel circuit, which includes an initialization stage, a data writing and compensation stage, a pre-light emitting stage and a light emitting stage. In the initialization stage, the reset signal, the second scanning signal and the second light emitting control signal are input so as to turn on the reset circuit, the compensation circuit and the second light emitting control circuit, and the reset voltage is applied to the control terminal, the first terminal and the second terminal of the drive circuit and the first terminal of the light emitting element. In the data writing and compensation stage, the first scanning signal, the second scanning signal and the data signal are input so as to turn on the data writing circuit, the drive circuit and the compensation circuit, and the data writing circuit writes the data signal into the drive circuit, the compensation circuit stores the data signal, and the compensation circuit compensates the drive circuit. In the pre-light emitting stage, the first light emitting control signal is input so as to turn on the first light emitting control circuit and the drive circuit, and the first light emitting control circuit applies the first voltage to the first terminal of the drive circuit. In the light emitting stage, the first light emitting control signal and the second light emitting control signal are input so as to turn on the first light emitting control circuit, the second light emitting control circuit and the drive circuit, and the second light emitting control circuit applies the drive current to the light emitting element to make it emit light. And the first scanning signal and the second scanning signal are simultaneously on signals within at least part of the above stages, and the first light emitting control signal and the second light emitting control signal are simultaneously on signals within at least part of the above stages.

For example, the driving method provided by at least one embodiment of the present disclosure further includes a data write holding stage. In the data write holding stage, the first scanning signal is input so as to turn on the data writing circuit, and the second scanning signal is input so as to turn off the compensation circuit for holding a voltage at the control terminal of the drive circuit.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
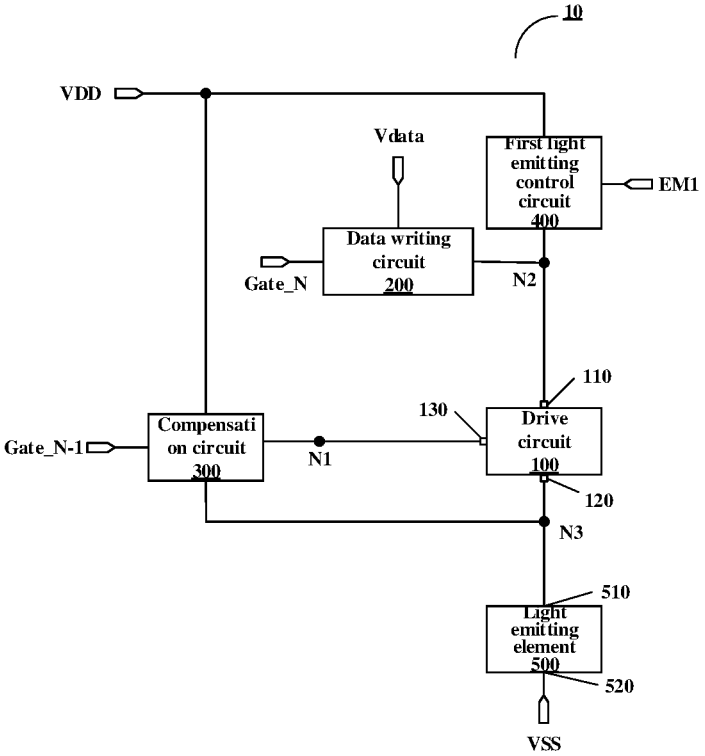
FIG. 1 is a schematic block diagram of a pixel circuit provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by those of ordinary skill in the art to which the present disclosure belongs. The terms "first," "second," etc., which are used in the description and the claims of the present disclosure, are not intended to indicate any sequence, amount or importance, but used to distinguish various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

Hereinafter, various embodiments of the present disclosure will be described in detail with reference to the accompanying drawings. It should be noted that in the drawings, like reference numerals are given to components having substantially same or similar structures and functions, and repeated descriptions thereof will be omitted.

OLED display devices generally include a plurality of pixel units arranged in an array, and each pixel unit may implement the basic function of driving the OLED to emit light with a pixel circuit. A basic pixel circuit used in an AMOLED display device is usually a 2T1C pixel circuit. That is, two TFT (Thin-film transistor) and a storage capacitor Cs are used to implement the basic function of driving the OLED to emit light. It should be noted that the pixel circuit in the embodiment of the present disclosure is not limited to the above pixel circuit, but may also be a pixel circuit of other structures, such as a pixel circuit of 4T1C, 4T2C, 6T1C or 8T2C, etc. In the process of displaying some video images, in order to reduce power consumption of the OLED, low-frequency signals may be adopted to drive a pixel circuit. However, in a case where all the above pixel circuits are implemented with P-type transistors, since the leakage current of the P-type transistors is relatively large, the use of low-frequency driving may cause phenomena such as flicker or the like, which limits the use of the pixel circuits.

At least one embodiment of the present disclosure provides a pixel circuit, which includes a drive circuit, a data writing circuit, a compensation circuit, and a light emitting element. The drive circuit includes a control terminal, a first terminal and a second terminal, and is configured to control a driving current flowing through the first terminal and the second terminal for driving the light emitting element to emit light. The data writing circuit is connected to a first terminal of the drive circuit and configured to write a data signal to the first terminal of the drive circuit in response to a first scanning signal. The compensation circuit is connected to a control terminal and a second terminal of the drive circuit and connected to a first voltage terminal, and is configured to store a data signal written by the data writing circuit and compensate the drive circuit in response to a second scanning signal. The light emitting element includes a first terminal and a second terminal. A first terminal of the light emitting element is configured to receive the drive current, and a second terminal of the light emitting element is connected to a second voltage terminal.

At least one embodiment of the present disclosure further provides a driving method and a display panel corresponding to the above pixel circuit.

In the pixel circuit provided in the embodiments of the present disclosure, on one hand, the pixel circuit adopts a mixing manner of P-type transistors and N-type transistors so that low-frequency driving may be implemented. Meanwhile, due to the small size of N-type transistors, the resolution of a display panel adopting the pixel circuit may be improved. On the other hand, since the leakage current of N-type transistors in the pixel circuit is small, there is no need to consider any aging problem of an N-type transistor in the use process of the pixel circuit.

Embodiments of the present disclosure are described in detail below with reference to the accompanying drawings. It should be noted that like reference numerals in different drawings will be used to refer to like elements already described.

Figure 2:
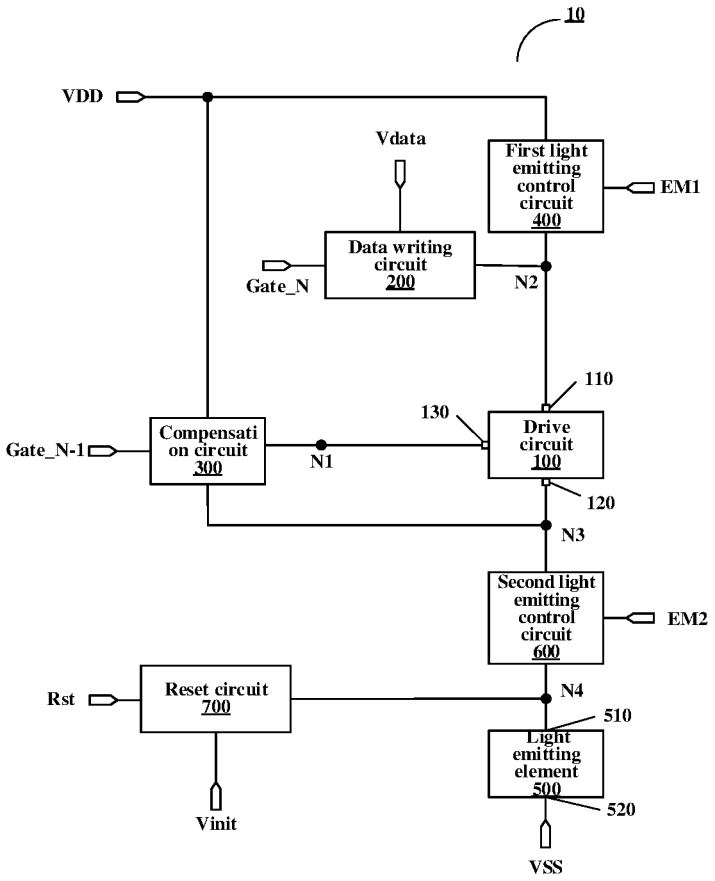
FIG. 2 is a schematic block diagram of another pixel circuit provided by some embodiments of the present disclosure.

Some embodiments of the present disclosure provide a pixel circuit 10, which, for example, may apply to a pixel unit of an OLED display device. As illustrated in FIGS. 1 and 2, the pixel circuit 10 includes a drive circuit 100, a data writing circuit 200, a compensation circuit 300, a first light emitting control circuit 400, and a light emitting element 500.

For example, the drive circuit 100 includes a first terminal 110, a second terminal 120, and a control terminal 130, and is configured to control a drive current for driving the light emitting element 500 to emit light. A control terminal 130 of the drive circuit 100 is connected to a first node N1, a first terminal 110 of the drive circuit 100 is connected to a second node N2, and a second terminal 120 of the drive circuit 100 is connected to a third node N3. For example, in a light emitting stage, the drive circuit 100 may supply a drive current to the light emitting element 500 for driving the light emitting element 500 to emit light, and may emit light according to a desired "gray scale". For example, the light emitting element 500 may be an OLED and is configured to be connected to the third node N3 and a second voltage terminal VSS (e.g., the second voltage terminal VSS provides a low level, e.g., the second voltage terminal VSS is grounded), and embodiments of the present disclosure include but are not limited to this.

For example, in other embodiments of the present disclosure, as illustrated in FIG. 2, in the case where the pixel circuit 10 includes a second light emitting control circuit 600, the light emitting element 500 may also be connected to the third node N3 via the second light emitting control circuit 600. Embodiments of the present disclosure include but are not limited to this.

For example, the data writing circuit 200 is connected to the first terminal 110 of the drive circuit 100 (a second node N2) and is configured to write a data signal to the first terminal 110 of the drive circuit 100 in response to a first scanning signal. For example, the data writing circuit 200 is connected to a data line (a data signal terminal Vdata), the second node N2, and a first scanning line (a first scanning signal terminal Gate_N). For example, a first scanning signal from the first scanning signal terminal Gate_N is applied to the data writing circuit 200 to control the data writing circuit 200 to be turned on or off.

For example, in a data writing and compensation stage, the data writing circuit 200 may be turned on in response to the first scanning signal, so that the data signal may be written to the first terminal 110 of the drive circuit 100 (the second node N2), and the data signal may be stored in the compensation circuit 300, so as to generate a drive current for driving the light emitting element 500 to emit light according to the data signal, for example, in the light emitting stage.

For example, the compensation circuit 300 is connected to the control terminal 130 (first node N1) and the second terminal 120 (third node N3) of the drive circuit, and is further connected to a first voltage terminal VDD. The compensation circuit 300 is configured to store the data signal written by the data writing circuit 200 and compensate the drive circuit 100 in response to a second scanning signal. For example, the compensation circuit 300 may be connected to a second scanning signal line (a second scanning signal terminal Gate_N−1), the first voltage terminal VDD, the first node N1, and the third node N3. For example, a second scanning signal from the second scanning signal terminal Gate_N−1 is applied to the compensation circuit 300 to control it to be turned on or off. For example, in the case where the compensation circuit 300 includes a capacitor, for example, in the data writing and compensation stage, the compensation circuit 300 may be turned on in response to the second scanning signal, so that the data signal written by the data writing circuit 200 may be stored in the capacitor. For example, meanwhile, in the data writing and compensation stage, the compensation circuit 300 may electrically connect the control terminal 130 and the second terminal 120 of the drive circuit 100, so that information related to a threshold voltage of the drive circuit 100 may be stored in the capacitor accordingly, thereby the drive circuit 100 may be controlled by the stored data signal and the threshold voltage, for example, in the light emitting stage, so that an output of the drive circuit 100 is compensated.

For example, the compensation circuit 300 may include an N-type transistor. For example, on-voltages of the N-type transistor and the P-type transistor are different. For example, the P-type transistor is turned on in response to a low-level signal, and the N-type transistor is turned on in response to a high-level signal (higher than the aforementioned low-level signal), so that the high-level data signal may be prevented from being written into the drive circuit and the compensation circuit in the light emitting stage to turn off the driving transistor, thereby avoiding a flicker phenomenon in the pixel circuit during low-frequency driving, and thus the pixel circuit may be suitable for low-frequency driving. For example, in the case where the N-type transistor is adopted, IGZO (Indium Gallium Zinc Oxide) may be used as an active layer of a thin film transistor, and compared with LTPS (Low Temperature Poly Silicon) or amorphous silicon (for example, hydrogenated amorphous silicon) used as the active layer of the thin film transistor, the size of the transistor can be effectively reduced and leakage current may be prevented, so that the resolution of a display panel adopting the pixel circuit may be improved while the pixel circuit is suitable for low-frequency driving. The following embodiments are the same as the above and will not be repeated.

For example, the first light emitting control circuit 400 is connected to the first terminal 110 of the drive circuit 100 (second node N2) and the first voltage terminal VDD, and is configured to apply a first voltage received by the first voltage terminal VDD to the first terminal 110 of the drive circuit 100 in response to the first light emitting control signal. For example, as illustrated in FIG. 1, the first light emitting control circuit 400 is connected to a first light emitting control terminal EM1, the first voltage terminal VDD, and the second node N2. For example, the first light emitting control terminal EM1 may be connected to a first light emitting control line providing the first light emitting control signal or connected to a control circuit providing the first light emitting control signal. For example, in the light emitting stage, the first light emitting control circuit 400 may be turned on in response to the first light emitting control signal, so that the first voltage VDD may be applied to the first terminal 110 of the drive circuit 100. In the case where the drive circuit 100 is turned on, the drive circuit 100 applies the first voltage VDD to the light emitting element 500 for provide a drive current, thereby driving the light emitting element to emit light. For example, the first voltage VDD may be a drive voltage, such as a high voltage (higher than a second voltage VSS).

For example, the light emitting element 500 includes a first terminal 510 configured to receive a drive current from the second terminal 120 of the drive circuit 100 and a second terminal 520 configured to be connected to the second voltage terminal VSS. For example, in some embodiments, as illustrated in FIG. 1, the first terminal 510 of the light emitting element 500 is connected to the third node N3. For example, in other embodiments of the present disclosure, as illustrated in FIG. 2, in the case where the pixel circuit 10 includes a second light emitting control circuit 600, the first terminal 510 of the light emitting element 500 may also be connected to a fourth node N4 and connected to the third node N3 via the second light emitting control circuit 600. Embodiments of the present disclosure include, but are not limited to this.

For example, as illustrated in FIG. 2, on the basis of the embodiment illustrated in FIG. 1, the pixel circuit 10 further includes a second light emitting control circuit 600 and a reset circuit 700.

For example, the second light emitting control circuit 600 is connected to a second light emitting control terminal EM2, the first terminal 510 of the light emitting element 500, and the second terminal 120 of the drive circuit 100 and configured to apply a drive current to the light emitting element 500 in response to a second light emitting control signal.

For example, in a light emitting stage, the second light emitting control circuit 600 is turned on in response to the second light emitting control signal provided by the second light emitting control terminal EM2, so that the drive circuit 100 may apply a drive current to the light emitting element 500 through the second light emitting control circuit 600 to cause it to emit light. In a non-light-emitting stage, the second light emitting control circuit 600 is turned off in response to the second light emitting control signal, thereby preventing a current from flowing through the light emitting element 500 to cause it to emit light, and improving contrast of a corresponding display device.

Still for example, in an initialization stage, the second light emitting control circuit 600 may be turned on in response to the second light emitting control signal, so that the reset circuit 700 may be combined to reset the drive circuit 100 and the light emitting element 500.

For example, the second light emitting control signal is different from the first light emitting control signal. For example, the above two signals may be connected to different signal output terminals, and for example, in the initialization stage, only the second light emitting control signal may be used as an on signal as described above. For example, the first light emitting control signal and the second light emitting control signal are simultaneously on signals within at least part of the above stages. For example, in the light emitting stage, the first light emitting control signal and the second light emitting control signal may be simultaneously on signals, so that the light emitting element 500 emits light. For example, in some embodiments, a falling edge of the second light emitting control signal may also be synchronized with a falling edge of the first light emitting control signal in timing, thereby directly causing the process to enter the light emitting stage from the data writing and compensation stage.

It should be noted that the first light emitting control signal and the second light emitting control signal described in the embodiments of the present disclosure are two light emitting control signals with different timing sequences. For example, in a display device, in the case where a plurality of pixel units are arranged in an array, for a row of pixel units, the first light emitting control signal may be a control signal that controls a first light emitting control circuit 400 in the pixel circuit 10 of the current row of pixel units, meanwhile the first light emitting control signal also controls a second light emitting control circuit 600 in the pixel circuit 10 of the previous row of pixel units. Similarly, the second light emitting control signal is a control signal that controls a second light emitting control circuit 600 in the pixel circuit 10 of the current row of pixel units, meanwhile the second light emitting control signal also controls a first light emitting control circuit 400 in the pixel circuit 10 of the next row of pixel units.

The layout space of the display panel may be simplified by the way that the pixel circuits in two rows of pixel units share a same light emitting control signal, so that the development of a high-resolution display panel may be implemented.

For example, the reset circuit 700 is connected to a reset voltage terminal Vinit and the first terminal 510 of the light emitting element 500, and is configured to apply a reset voltage received from the reset voltage terminal Vinit to the first terminal 510 of the light emitting element 500 in response to a reset signal. For example, the reset signal is a second scanning signal, and the reset signal may also be other signals synchronized with the second scanning signal. The embodiments of the present disclosure are not limited to this. For example, as illustrated in FIG. 2, the reset circuit 700 is connected to the fourth node N4, the reset voltage terminal Vinit, the first terminal 510 of the light emitting element 500, and a reset control terminal Rst (a reset control line), respectively. For example, in an initialization stage, the reset circuit 700 may be turned on in response to a reset signal, so that a reset voltage may be applied to the first terminal 510 of the light emitting element 500 (fourth node N4), and the reset voltage may be reapplied to the third node N3 through the second light emitting control circuit 600, and the reset voltage may be reapplied to the first node N1 through the compensation circuit 300, so that the drive circuit 100, the compensation circuit 300, and the light emitting element 500 may be reset to eliminate the influence of the previous light emitting stage. For example, the reset circuit 700 may be implemented by using an N-type transistor.

In the pixel circuit provided by some embodiments of the present disclosure, the type of the transistor in the compensation circuit 300 and that of the transistor in the drive circuit 100 may be different. For example, the compensation circuit 300 includes an N-type transistor and the drive circuit 100 includes a P-type transistor.

According to the pixel circuit provided by the embodiments of the present disclosure, on one hand, the pixel circuit includes an N-type transistor and a P-type transistor at the same time. Because the leakage current of the N-type transistor is small, the flicker phenomenon may be avoided when the pixel circuit is used for low-frequency driving; and because the size of the N-type transistor is small, the resolution of a display panel adopting the pixel circuit may be improved. On the other hand, because the leakage current of the N-type transistor in the pixel circuit is small, there is no need to consider an aging problem of the N-type transistor.

For example, in the case where the drive circuit 100 is implemented as a driving transistor, for example, a gate electrode of the driving transistor may serve as the control terminal 130 of the drive circuit 100 (connected to the first node N1), a first electrode (e.g., a source electrode) may serve as the first terminal 110 of the drive circuit 100 (connected to the second node N2), and a second electrode (e.g., a drain electrode) may serve as the second terminal 120 of the drive circuit 100 (connected to the third node N3).

It should be noted that, in the embodiments of the present disclosure, the first voltage terminal VDD, for example, holds an input DC high level signal, and the DC high level is referred as a first voltage. The second voltage terminal VSS, for example, holds an input DC low level signal, and the DC low level is referred as a second voltage which is lower than the first voltage. The following embodiments are the same and will not be repeated.

It should be noted that, in the embodiments of the present disclosure, the first node N1, the second node N2, the third node N3, and the fourth node N4 do not represent actual components, but rather represent junction points of related circuit connections in the circuit diagram.

In addition, it should be noted that in the embodiments of the present disclosure, the symbol Vdata may represent both the data signal terminal and the level of the data signal. Similarly, the symbol Vinit may represent both the reset voltage terminal and the reset voltage, the symbol VDD may represent both the first voltage terminal and the first voltage, and the symbol VSS may represent both the second voltage terminal and the second voltage. The above notes also apply to the following embodiments and will not be repeated.

Figure 3:
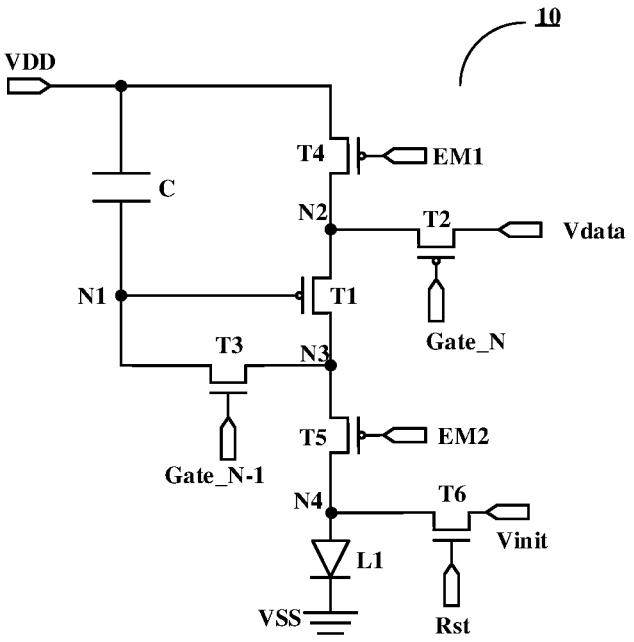
FIG. 3 is a circuit diagram of one implementation example of the pixel circuit illustrated in FIG. 2.

For example, the pixel circuit 10 illustrated in FIG. 2 may be implemented as a circuit structure illustrated in FIG. 3. As illustrated in FIG. 3, the pixel circuit 10 includes first to sixth transistors T1, T2, T3, T4, T5 and T6 and includes a capacitor C and a light emitting element L1. For example, the first transistor T1 is used as a driving transistor, and the other transistors, i.e., the second to sixth transistors, may be used as switching transistors. For example, the light emitting element L1 may be various types of OLED, such as top emission, bottom emission, double-sided emission, etc., and may emit red light, green light, blue light, white light, etc. The embodiments of the present disclosure are not limited thereto.

For example, as illustrated in FIG. 3, in more detail, the drive circuit 100 may be implemented as the first transistor T1. A gate electrode of the first transistor T1 serves as the control terminal 130 of the drive circuit 100 and is connected to the first node N1. A first electrode of the first transistor T1 serves as the first terminal 110 of the drive circuit 100 and is connected to the second node N2. A second electrode of the first transistor T1 serves as the second terminal 120 of the drive circuit 100 and is connected to the third node N3. For example, the first transistor T1 is a P-type transistor. For example, the P-type transistor is turned on in response to a low-level signal. The above notes also apply to the following embodiments and thus will not be repeated. It should be noted that the embodiments of the present disclosure are not limited to this, and the drive circuit 100 may be a circuit composed of other components.

The data writing circuit 200 may be implemented as a second transistor T2. A gate electrode of the second transistor T2 is connected to a first scanning line (a first scanning signal terminal Gate_N) for receiving a first scanning signal. A first electrode of the second transistor T2 is connected to a data line (a data signal terminal Vdata) for receiving a data signal, and a second electrode of the second transistor T2 is connected to the first terminal 110 of the drive circuit 100 (the second node N2). For example, the second transistor T2 is a P-type transistor, and for example, it may be a thin film transistor whose active layer is low temperature doped polysilicon. It should be noted that the embodiments of the present disclosure are not limited to this, and the data writing circuit 200 may be a circuit composed of other components.

The compensation circuit 300 may be implemented to include a third transistor T3 and a capacitor C. A gate electrode of the third transistor T3 is configured to be connected to a second scanning line (a second scanning signal terminal Gate_N−1) for receiving a scanning signal, a first electrode of the third transistor T3 is connected to the control terminal 130 (first node N1) of the drive circuit 100, and a second electrode of the third transistor T3 is connected to the second terminal 120 (third node N3) of the drive circuit 100. And a first electrode of the capacitor C is connected to the control terminal 130 of the drive circuit 100, and a second electrode of the capacitor C is connected to the first voltage terminal VDD. The third transistor T3 is an N-type transistor. For example, in the case where the third transistor T3 adopts an N-type transistor, IGZO may be adopted as an active layer of a thin film transistor for reducing the size of the transistor and preventing a leakage current. For example, the N-type transistor is turned on in response to a high-level signal, and such a case may also apply to the following embodiments and will not be repeated. It should be noted that the embodiments of the present disclosure are not limited to this, and the compensation circuit 300 may also be a circuit composed of other components.

The first light emitting control circuit 400 may be implemented as a fourth transistor T4. A gate electrode of the fourth transistor T4 is connected to a first light emitting control line (first light emitting control terminal EM1) for receiving a first light emitting control signal, a first electrode of the fourth transistor T4 is connected to the first voltage terminal VDD for receiving a first voltage, and a second electrode of the fourth transistor T4 is connected to the first terminal 110 of the driving transistor (second node N2). The fourth transistor T4 is a P-type transistor, for example, is a thin film transistor whose active layer is low temperature doped polysilicon. It should be noted that the embodiments of the present disclosure are not limited to this, and the first light emitting control circuit 400 may be a circuit composed of other components.

The first terminal 510 (e.g., anode electrode) of the light emitting element L1 is connected to a fourth node N4 and is configured to receive a drive current from the second terminal 120 of the drive circuit 100 through the second light emitting control circuit 600, and the second terminal 520 (e.g., cathode electrode) of the light emitting element L1 is configured to be connected to a second voltage terminal VSS for receiving a second voltage. For example, the second voltage terminal VSS may be grounded, that is, the second voltage VSS may be 0V.

The second light emitting control circuit 600 may be implemented as a fifth transistor T5. A gate electrode of the fifth transistor T5 is connected to a second light emitting control line (second light emitting control terminal EM2) for receiving a second light emitting control signal. A first electrode of the fifth transistor T5 is connected to the second terminal 120 of the drive circuit 100 (third node N3), and a second electrode of the fifth transistor T5 is connected to the first terminal 510 of the light emitting element L1 (fourth node N4). For example, the fifth transistor T5 is a P-type transistor, for example, is a thin film transistor whose active layer is low temperature doped polysilicon. It should be noted that the embodiments of the present disclosure are not limited to this, and the second light emitting control circuit 700 may be a circuit composed of other components.

The reset circuit 400 may be implemented as a sixth transistor T6. A gate electrode of the sixth transistor T6 is configured to be connected to a second scanning line (reset control terminal Rst) for receiving a second scanning signal as a reset signal. A first electrode of the sixth transistor T6 is connected to a reset voltage terminal Vinit for receiving a reset voltage, and a second electrode of the sixth transistor T6 is configured to be connected to the first terminal 510 of the light emitting element L1. For example, the sixth transistor T6 is an N-type transistor, for example, is a thin film transistor whose active layer is IGZO. It should be noted that the embodiments of the present disclosure are not limited to this, and the reset circuit 400 may also be a circuit composed of other components.

In a process of displaying some video images, in order to reduce the power consumption of OLED, a low-frequency signal may be used to drive a pixel circuit. However, in the case where all the pixel circuits are implemented with P-type transistors, because the leakage current of a P-type transistor is large, the use of low-frequency driving may cause a Flicker phenomenon or the like, so that the use of the pixel circuit is limited. In the pixel circuit provided by the embodiments of the present disclosure, the pixel circuit mixes N-type and P-type transistors. For example, the third transistor T3 and the sixth transistor T6 adopt N-type transistors, and the remaining transistors adopt P-type transistors. Because the leakage current of the N-type transistors is small, the flicker phenomenon may be avoided when the pixel circuit is used for low-frequency driving. In addition, because the third transistor T3 in the compensation circuit in the pixel circuit adopts an N-type transistor with smaller leakage current and smaller size, the capacitor C in the compensation circuit may adopt a capacitor with smaller size, thus the resolution of a display panel adopting the pixel circuit may be improved. Meanwhile, because the leakage current of the N-type transistor is smaller, there is no need to consider an aging problem of the N-type transistor.

The operation principle of the pixel circuit 10 illustrated in FIG. 3 will be described below with reference to the signal timing diagram illustrated in FIG. 4.

Figure 4:
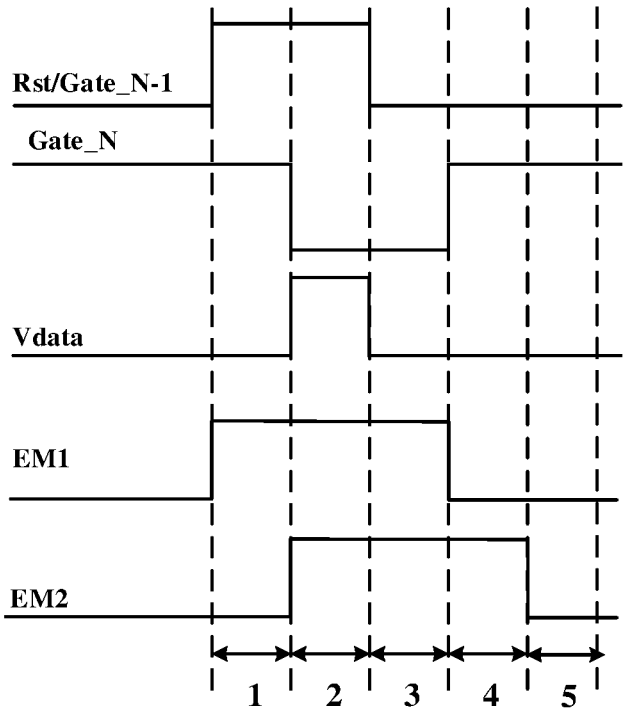
FIG. 4 is a timing diagram of a driving method of a pixel circuit provided by some embodiments of the present disclosure.

As illustrated in FIG. 4, the display process of each frame image includes five stages, respectively, initialization stage 1, data writing and compensation stage 2, data write holding stage 3, pre-light emitting stage 4 and light emitting stage 5. The FIG. 4 illustrates a timing waveform of respective signal in each stage.

Figure 5:
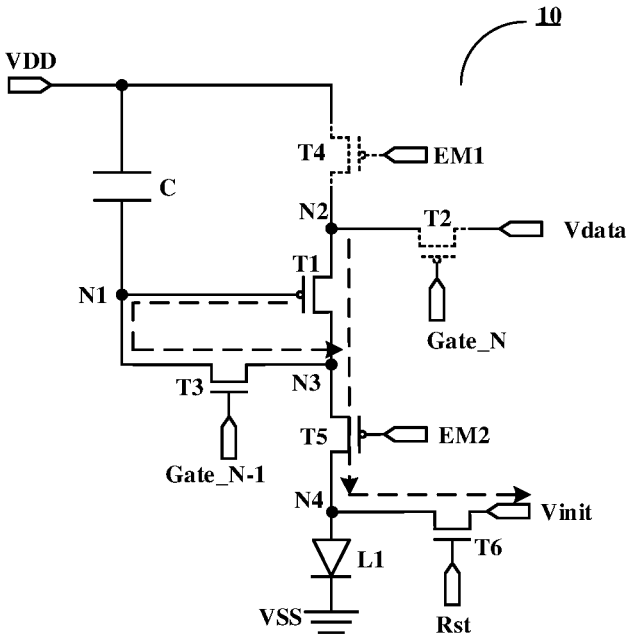
FIGS. 5 to 9 are circuit diagrams of the pixel circuit illustrated in FIG. 3 corresponding to five stages in FIG. 4, respectively.
Figure 6:
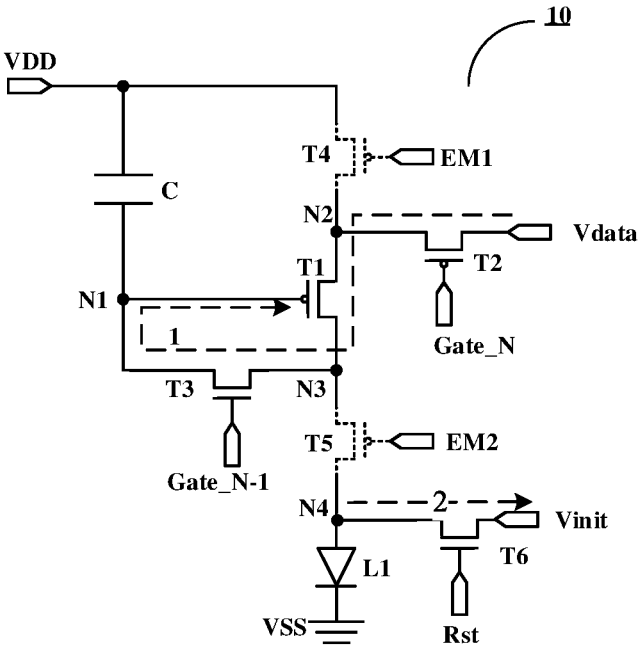
Figure 7:
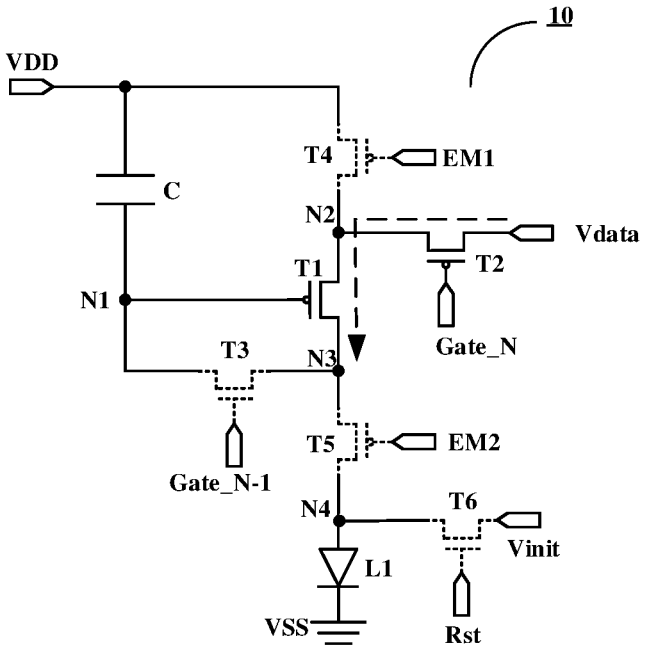
Figure 8:
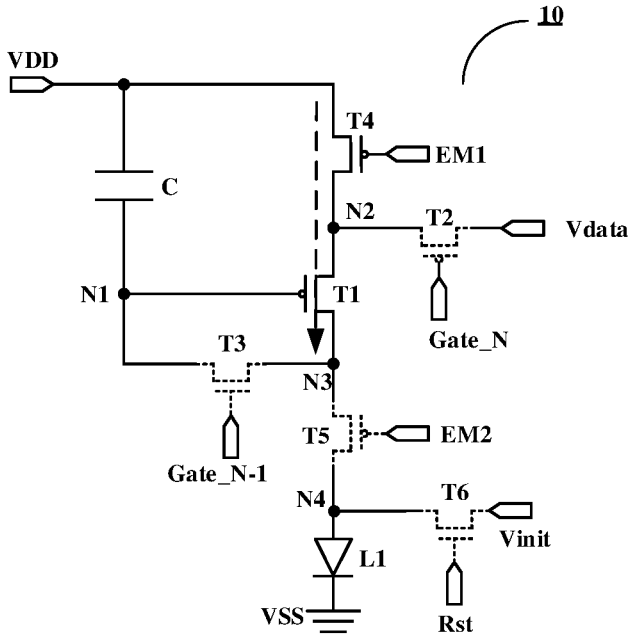
Figure 9:
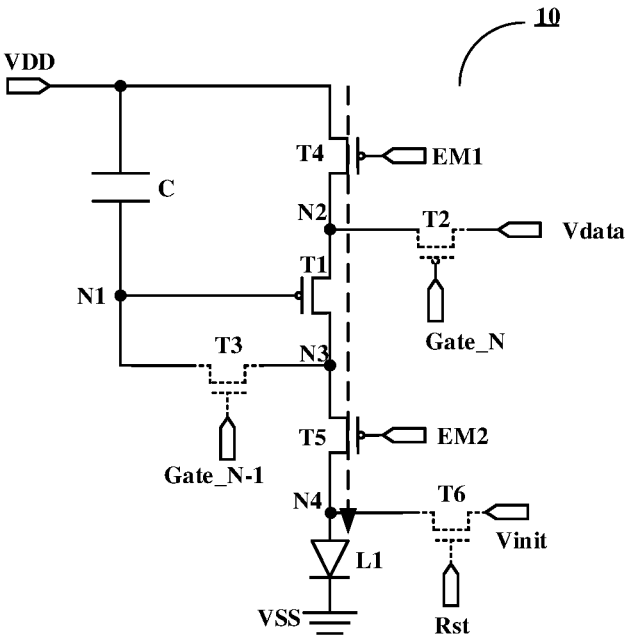

It should be noted that FIG. 5 is a schematic diagram in the case where the pixel circuit illustrated in FIG. 3 is in the initialization stage 1, FIG. 6 is a schematic diagram in the case where the pixel circuit illustrated in FIG. 3 is in the data writing and compensation stage 2, FIG. 7 is a schematic diagram in the case where the pixel circuit illustrated in FIG. 3 is in the data writing and holding stage 3, FIG. 8 is a schematic diagram in the case where the pixel circuit illustrated in FIG. 3 is in the pre-light emitting stage 4, and FIG. 9 is a schematic diagram in the case where the pixel circuit illustrated in FIG. 3 is in the light emitting stage 5. In addition, the transistors identified by dashed lines in FIGS. 5 to 9 all indicate that they are at the off state in the corresponding stage, and the dashed lines with arrows in FIGS. 5 to 9 indicate a current direction of the pixel circuit in the corresponding stage. The transistors illustrated in FIGS. 5 to 9 are all illustrated by taking the first transistor T1 and the sixth transistor T6 as N-type transistors and the other transistors as P-type transistors as an example, i.e., respective N-type transistor is turned on in a case where a gate electrode thereof is connected to a high level and turned off in a case where a gate electrode thereof is connected to a low level, and respective P-type transistor is turned on in a case where a gate electrode thereof is connected to a low level and turned off in a case where a gate electrode thereof is connected to a high level. The above notes also apply to the following examples and will not be repeated.

In the initialization stage 1, a reset signal, a second scanning signal, and a second light emitting control signal are input to turn on the reset circuit 700, the compensation circuit 300, and the second light emitting control circuit 600, so that a reset voltage may be applied to the control terminal 130, the first terminal 110, and the second terminal 120 of the drive circuit 100, and the first terminal 510 of the light emitting element 500. For example, as illustrated in FIG. 4, the second scanning signal is synchronized with the reset signal, i.e., the reset signal may also be the second scanning signal. The above descriptions also apply to the following embodiments and will not be repeated.

As illustrated in FIGS. 4 and 5, in the initialization stage 1, because the third transistor T3 and the sixth transistor T6 are N-type transistors, the sixth transistor T6 is turned on by a high level of the reset signal, the third transistor T3 is turned on by a high level of the second scanning signal, and the fifth transistor T5 is turned on by a low level of the second light emitting control signal. Meanwhile, the second transistor T2 is turned off by a high level of the first scanning signal, and the fourth transistor T4 is turned off by a high level of the first light emitting control signal.

As illustrated in FIG. 5, in the initialization stage 1, a reset path is formed (as illustrated by the dashed lines with arrows in FIG. 5). Therefore, in this stage, the storage capacitor C and the gate electrode of the first transistor T1 are discharged via the third transistor T3, the fifth transistor T5 and the sixth transistor T6, the first transistor T1 is discharged through the fifth transistor T5 and the sixth transistor T6, and the light emitting element L1 is discharged through the sixth transistor T6, and thereby the first node N1, the second node N2, the third node N3, and the light emitting element L1 (i.e., the fourth node N4) are reset. Thus, potentials of the first node N1, the third node N3, and the fourth node N4 after the initialization stage 1 are reset voltages Vinit (low level signals, for example, may be grounded or other low level signals). In this stage, because the first transistor T1 and the fifth transistor T5 are turned on and the fourth transistor T4 is turned off, a potential of a source electrode of the first transistor T1 is discharged to Vinit-Vth where the first transistor T1 is turned off according to the characteristics of the first transistor T1 itself. Therefore, after the initialization stage 1 is completed, a voltage VGS between the gate electrode (i.e., the first node N1) and the source electrode (i.e., the second node N2) of the first transistor T1 may satisfy: $|VGS|<|Vth|$, so that the first transistor T1 is in an off state where the VGS is fixedly biased (off-bias). With such a configuration, whether a data signal of the previous frame is a black signal or a white signal, the first transistor T1 starts to enter the data writing and compensation stage 2 from the off-bias state, thereby the short-term afterimage problem possibly caused by the hysteresis effect of a display device adopting the pixel circuit 10 may be solved.

After the initialization stage 1, the potential of the first node N1 is the reset voltage Vinit, and the potential of the second node N2 is Vinit-Vth. In the initialization stage 1, the capacitor C is reset so that the electric charge stored in the capacitor C is discharged, thereby data signals in subsequent stages may be stored in the capacitor C more quickly and reliably. Meanwhile, the third node N3 and the light emitting element L1 (i.e., the fourth node N4) are also reset, so that the light emitting element L1 may be displayed in a black state without emitting light before the light emitting stage 5, and display effects such as contrast or the like of a display device adopting the pixel circuit described above may be improved.

In the data writing and compensation stage 2, a first scanning signal, a second scanning signal and a data signal are input to turn on the data writing circuit 200, the drive circuit 100 and the compensation circuit 300. The data signal is written by the data writing circuit 200 into the drive circuit 100, and stored by the compensation circuit 300, and the compensation circuit 300 compensates the drive circuit 100.

As illustrated in FIGS. 4 and 6, in the data writing and compensation stage 2, the second transistor T2 is turned on by a low level of the first scanning signal, and the third transistor T3 is turned on by a high level of the second scanning signal. In this example, because the second scanning signal is a reset signal, the sixth transistor T6 is turned on by a high level of the reset signal. Meanwhile, the fourth transistor T4 is turned off by a high level of the first light emitting control signal, and the fifth transistor T5 is turned off by a high level of the second light emitting control signal.

As illustrated in FIG. 6, in the data writing and compensation stage 2, a data writing and compensation path (illustrated by a dashed line 1 with an arrow in FIG. 6) and a reset path (illustrated by a dashed line 2 with an arrow in FIG. 6) are formed. A data signal charges the first node N1 (i.e., charging the capacitor C) after passing through the second transistor T2, the first transistor T1 and the third transistor T3, that is, the potential of the first node N1 is increased. It is easy to understand that the potential of the second node N2 is maintained at Vdata, and meanwhile, according to the characteristics of the first transistor T1 itself, when the potential of the first node N1 increases to Vdata+Vth, the first transistor T1 is turned off and the charging process ends. It should be noted that Vdata represents a voltage value of the data signal, and Vth represents a threshold voltage of the first transistor T1. Because the first transistor T1 is illustrated by taking a P-type transistor as an example, the threshold voltage Vth may be a negative value here. Meanwhile, in this stage, the fourth node N4 continues to discharge through the sixth transistor T6, thus the voltage of the fourth node N4 is still the reset voltage Vinit. It should be noted that in this stage, the reset circuit 700 may also be turned off in response to other reset signals without affecting the subsequent light emitting stage of the pixel circuit, and the embodiments of the present disclosure are not limited to this.

After the data writing stage 2, the potentials of the first node N1 and the third node N3 are both Vdata+Vth, that is, voltage information with the data signal and the threshold voltage Vth is stored in the capacitor C for providing gray-scale display data and compensating the threshold voltage of the first transistor T1 itself in the subsequent light emitting stage.

In the data writing and holding stage 3, a first scanning signal is input to turn on the data writing circuit 200, and a second scanning signal is input to turn off the compensation circuit 300 for holding a voltage at the control terminal 130 of the drive circuit 100.

As illustrated in FIGS. 4 and 7, in the data writing and holding stage 3, the second transistor T2 is turned on by a low level of the first scanning signal. Meanwhile, the third transistor T3 is turned off by a low level of the second scanning signal. In this example, because the second scanning signal is a reset signal, the sixth transistor T6 is turned off by a low level of the reset signal, the fourth transistor T4 is turned off by a high level of the first light emitting control signal, and the fifth transistor T5 is turned off by a high level of the second light emitting control signal.

As illustrated in FIG. 7, in the data writing and holding stage 3, a data writing and holding path is formed (as illustrated by a dashed line with an arrow in FIG. 7). In this stage, the third transistor T3 is turned off, and the potential of the first node N1 is maintained at Vdata+Vth due to the characteristics of the capacitance.

After the data writing and holding stage 3, the potential of the first node N1 is held at Vdata+Vth. That is, the voltage information with the data signal and the threshold voltage Vth is continuously stored in the capacitor C for providing gray-scale display data and compensating the threshold voltage of the first transistor T1 itself in the subsequent light emitting stage.

In the pre-light emitting stage 4, a first light emitting control signal is input to turn on the first light emitting control circuit 400 and the drive circuit 100, and the first light emitting control circuit 400 applies a first voltage to the first terminal 110 of the drive circuit 100.

As illustrated in FIGS. 4 and 8, in the pre-light emitting stage 4, the fourth transistor T4 is turned on by a low level of the first light emitting control signal. Meanwhile, the second transistor T2 is turned off by a high level of the first scanning signal, the third transistor T3 is turned off by a low level of the second scanning signal, the sixth transistor T6 is turned off by a low level of the reset signal, and the fifth transistor T5 is turned off by a high level of the second light emitting control signal.

As illustrated in FIG. 8, in the pre-light emitting stage 4, a pre-light emitting path is formed (as illustrated by a dashed line with an arrow in FIG. 8). The first voltage is transmitted to the second node N2 through the fourth transistor T4, and the potential of the second node N2 changes from Vdata to the first voltage VDD. Because the fifth transistor T5 is turned off at this stage, preparation is made for light emitting of the light emitting element L1 at the next stage.

In the light emitting stage 5, a first light emitting control signal and a second light emitting control signal are input to turn on the first light emitting control circuit 400, the second light emitting control circuit 600, and the drive circuit 100, and the second light emitting control circuit 600 applies a drive current to the light emitting element L1 so that it emits light.

As illustrated in FIGS. 4 and 9, in the light emitting stage 5, the fourth transistor T4 is turned on by a low level of the first light emitting control signal, and the fifth transistor T5 is turned on by a low level of the second light emitting control signal. Meanwhile, the second transistor T2 is turned off by a high level of the first scanning signal, the third transistor T3 is turned off by a low level of the second scan signal, and the sixth transistor T6 is turned off by a low level of the reset signal. Meanwhile, the potential of the first node N1 is Vdata+Vth and the potential of the second node N2 is VDD, thus the first transistor T1 is also kept on in this stage.

As illustrated in FIG. 9, in the light emitting stage 5, a driving light emitting path is formed (as illustrated by a dashed line with an arrow in FIG. 9). The light emitting element L1 may emit light under the effect of a drive current flowing through the first transistor T1.

Specifically, a value of a drive current $I_{L1}$ flowing through the light emitting element L1 may be obtained according to the following formula:

$$I_{L1}=K(V_{GS}-Vth)2$$

$$=K[(V\text{data}+Vth-VDD)-Vth]2$$

$$=K(V\text{data}-VDD)2$$

and in which $K=W*C_{OX}*U/L_o$

In the above formula, Vth represents a threshold voltage of the first transistor T1, $V_{GS}$ represents a voltage difference between the gate electrode and the source electrode (here, the first electrode) of the first transistor T1, and K is a constant value related to the first transistor T1 itself. From the above calculation formula about $I_{L1}$, it can be seen that the drive current $I_{L1}$ flowing through the light emitting element L1 is no longer related to the threshold voltage Vth of the first transistor T1, thus compensation for the pixel circuit may be implemented, the problem of threshold voltage drift of the driving transistor (the first transistor T1 in the embodiments of the present disclosure) caused by technological process and long-term operation is solved, and the impact on the driving current $I_{L1}$ is eliminated, so that the display effect of a display device adopting the pixel circuit may be improved.

It should be noted that the transistors adopted in the embodiments of the present disclosure may all be thin film transistors or field effect transistors or other switching devices with the same characteristics, and the embodiments of the present disclosure are all illustrated by taking thin film transistors as examples. A source electrode and drain electrode of the transistor used here may be symmetrical in structure, so the source electrode and drain electrode may be structurally indistinguishable. In the embodiments of the present disclosure, in order to distinguish the two electrodes of a transistor except a gate electrode, one electrode is directly described as a first electrode and the other electrode is described as a second electrode.

In addition, it should be noted that the transistors in the pixel circuit 10 illustrated in FIG. 3 are illustrated by taking the example that the third transistor T3 and the sixth transistor T6 are N-type transistors and the other transistors are P-type transistors. As illustrated in FIG. 5, a cathode electrode of the light emitting element L1 in the pixel circuit 10 is connected to the second voltage terminal VSS for receiving the second voltage. For example, in a display panel, in a case where the pixel circuit 10 illustrated in FIG. 5 is arranged in an array, the cathode electrodes of the light emitting elements L1 may be electrically connected to a same voltage terminal, i.e., in a manner of sharing a common cathode.

At least one embodiment of the present disclosure further provides a display panel, which includes a plurality of pixel units arranged in an array, and each of the plurality of pixel units includes the pixel circuit provided in any embodiment of the present disclosure.

Figure 10:
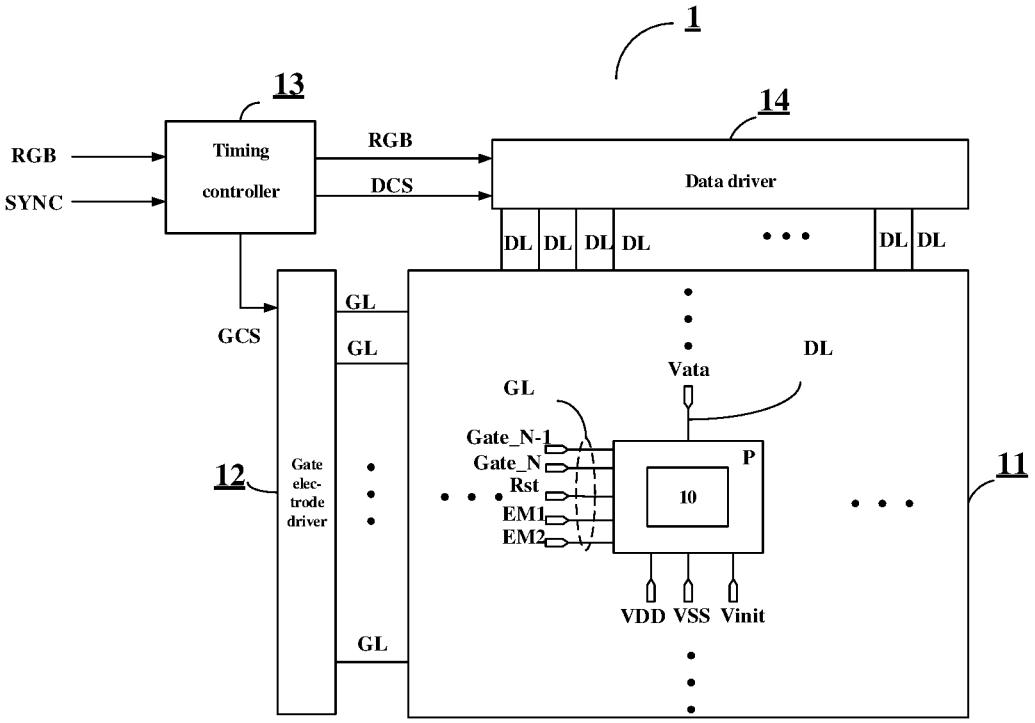
FIG. 10 is a schematic diagram of a display panel provided by some embodiments of the present disclosure.

FIG. 10 is a schematic block diagram of a display panel according to an embodiment of the present disclosure. As illustrated in FIG. 10, a display panel 11 is provided in a display device 1 and is electrically connected to a gate electrode driver 12, a timing controller 13, and a data driver 14. The display panel 11 includes pixel units P defined by crossing a plurality of scanning lines GL and a plurality of data lines DL. The gate electrode driver 12 is used to drive the plurality of scanning lines GL. The data driver 14 is used to drive the plurality of data lines DL. The timing controller 13 is used to process an image data RGB input from outside of the display device 1, supply the processed image data RGB to the data driver 14, and output a scanning control signal GCS and a data control signal DCS to the gate electrode driver 12 and the data driver 14 so as to control the gate electrode driver 12 and the data driver 14.

For example, the display panel 11 includes a plurality of pixel units P which include the pixel circuit 10 provided in any of the above embodiments. For example, the pixel unit P includes the pixel circuit 10 illustrated in FIG. 3. As illustrated in FIG. 10, the display panel 11 further includes a plurality of scanning lines GL and a plurality of data lines DL. For example, the plurality of scanning lines GL are correspondingly connected to the data writing circuit 200 in the pixel circuit 10 of each row of pixel units for providing a first scanning signal, and the plurality of scanning lines are also correspondingly connected to the compensation circuit 300 and the reset circuit 700 in the pixel circuit 10 of each row of pixel units for taking a second scanning signal as a reset signal.

For example, the pixel unit P is arrange in an intersection region of scanning lines GL and data lines DL. For example, as illustrated in FIG. 10, each pixel unit P is connected to five scanning lines GL (respectively providing a first scanning signal, a second scanning signal, a reset signal, a first light emitting control signal, and a second light emitting control signal), one data line DL, a first voltage line for providing a first voltage, a second voltage line for providing a second voltage, and a reset voltage line for providing a reset voltage. For example, the first voltage line or the second voltage line may be replaced with a corresponding plate-shaped common electrode (e.g., a common anode electrode or a common cathode electrode). It should be noted that that only a portion of the pixel unit P, scanning lines GL, and data lines DL are illustrated in FIG. 10. It should be noted that in the embodiments of the present disclosure, because the second scanning signal provided by the second scanning line is used as a reset signal, each pixel unit P may be connected to only four scanning lines GL, that is, the above-mentioned second scanning signal and reset signal are provided by the same second scanning line GL. It should be noted that the above descriptions also apply to the following embodiments and will not be repeated.

For example, the plurality of pixel units P are arranged in a plurality of rows, the compensation circuit 300 and the reset circuit 700 of the pixel circuit of each row of pixel units P are connected to the same scanning line GL, and the data writing circuit 200 of the pixel circuit of each row of pixel units P is connected to another scanning line GL for receiving a first scanning signal. For example, a data line DL of each column is connected to a data writing circuit 200 in the pixel circuit 10 of this column for providing a data signal.

For example, in the case where the pixel circuit 10 includes the second light emitting control circuit 600, the display panel may further include a plurality of light emitting control lines.

For example, a plurality of pixel units are arranged in a plurality of rows, and the second light emitting control circuit of the pixel circuit of a nth (n is an integer greater than zero) row of pixel units and the first light emitting control circuit of the pixel circuit of a (n+1)th row of pixel units are connected to a same light emitting control line. For example, the first light emitting control circuit of the pixel circuit of the first row of pixel units is connected to a same light emitting control line, the second light emitting control circuit of the pixel circuit of the first row of pixel units and the first light emitting control circuit of the pixel circuit of the second row of pixel units are connected to a same light emitting control line, the second light emitting control circuit of the pixel circuit of the second row of pixel units and the first light emitting control circuit of the pixel circuit of the third row of pixel units are connected to a same light emitting control line, in this way, the arrangement of the light emitting control lines is completed.

In the display panel provided by some embodiments of the present disclosure, pixel circuits of adjacent rows of pixel units may share a same light emitting control line, thus the layout space of the display panel may be saved in this manner and thereby the development of a high-resolution display panel may be implemented.

For example, the gate electrode driver 12 supplies a plurality of strobe signals to a plurality of scanning lines GL according to a plurality of scanning control signals GCS derived from the timing controller 13. The plurality of strobe signals include a first scanning signal, a second scanning signal, a first light emitting control signal, a second light emitting control signal, and a reset signal (i.e., the second scanning signal). These signals are supplied to each pixel unit P through a plurality of scanning lines GL.

For example, the data driver 14 converts a digital image data RGB input from the timing controller 13 into a data signal according to a plurality of data control signals DCS derived from the timing controller 13 using a reference gamma voltage. The data driver 14 supplies the converted data signal to a plurality of data lines DL.

For example, the timing controller 13 processes an image data RGB input from outside for matching the size and resolution of the display panel 11, and then supplies the processed image data to the data driver 14. The timing controller 13 generates a plurality of scanning control signals GCS and a plurality of data control signals DCS using a synchronization signal (e.g., a dot clock DCLK, a data enable signal DE, a horizontal synchronization signal Hsync and a vertical synchronization signal Vsync) input from outside of the display device. The timing controller 13 supplies the generated scanning control signal GCS and the data control signal DCS to the gate electrode driver 12 and the data driver 14, respectively, for control of the gate electrode driver 12 and the data driver 14.

For example, the data driver 14 may be connected to a plurality of data lines DL for providing a data signal Vdata. Meanwhile, it may also be connected to a plurality of first voltage lines, a plurality of second voltage lines and a plurality of reset voltage lines for providing a first voltage, a second voltage and a reset voltage respectively.

For example, the gate electrode driver 12 and the data driver 14 may be implemented as semiconductor chips. The display device 1 may also include other components, such as a signal decoding circuit, a voltage conversion circuit, etc.

These components may, for example, adopt conventional components, which will not be repeated here.

For example, the display panel 11 provided by some embodiments of the present disclosure may be applied to any product or component having a display function such as an electronic paper, a mobile phone, a tablet computer, a television, a display, a notebook computer, a digital photo frame, a navigator, and the like.

Regarding the technical effects of the display panel 11, reference may be made to the technical effects of the pixel circuit 10 provided in the aforesaid embodiments of the present disclosure, and details thereof are not described herein again.

Some embodiments of the present disclosure also provide a driving method, which may be used for driving the pixel circuit 10 provided by the embodiments of the present disclosure. For example, in the case where the pixel circuit 10 adopts the circuit structure illustrated in FIG. 1, the driving method includes operations as follows.

In a data writing and compensation stage, a first scanning signal, a second scanning signal and a data signal are input so as to turn on the data writing circuit 200, the drive circuit 100 and the compensation circuit 300; the data signal is written into the drive circuit 100 by the data writing circuit 200, the data signal is stored by the compensation circuit 300, and the drive circuit 100 is compensated by the compensation circuit 300.

In a light emitting stage, a first light emitting control signal is input so as to turn on the first light emitting control circuit 400 and the drive circuit 100, and a drive current is applied, by the first light emitting control circuit 400, to the light emitting element so that the light emitting element emits light.

For example, the first scanning signal and the second scanning signal are simultaneously on signals within at least part of the above stages.

For example, in the case where the pixel circuit 10 includes the second light emitting control circuit 600, the driving method includes the operations as follows.

In an initialization stage, a reset signal, a second scanning signal and a second light emitting control signal are input so as to turn on the reset circuit 700, the compensation circuit 300 and the second light emitting control circuit 600, and a reset voltage is applied to the control terminal 130, the first terminal 110 and the second terminal 120 of the drive circuit 100, as well as the first terminal 510 of the light emitting element 500.

In a data writing and compensation stage, a first scanning signal, a second scanning signal and a data signal are input so as to turn on the data writing circuit 200, the drive circuit 100 and the compensation circuit 300, the data signal is written into the drive circuit 100 by the data writing circuit 200, the data signal is stored by the compensation circuit 300, and the drive circuit 100 is compensated by the compensation circuit 300.

In a pre-light emitting stage, a first light emitting control signal is input so as to turn on the first light emitting control circuit 400 and the drive circuit 100, and a first voltage is applied, by the first light emitting control circuit 400, to the first terminal 110 of the drive circuit 100.

In a light-emitting stage, a first light emitting control signal and a second light emitting control signal are input so as to turn on the first light emitting control circuit 400, the second light emitting control circuit 600 and the drive circuit 100, and a drive current is applied, by the second light emitting control circuit 600, to the light emitting element 500 so that it emits light.

For example, in this example, the first scanning signal and the second scanning signal are simultaneously on signals within at least part of the above stages, and the first light emitting control signal and the second light emitting control signal are simultaneously on signals for at least part of the above stages.

For example, in other embodiments, the driving method may further include a data writing and holding stage.

In the data writing and holding stage, a first scanning signal and a data signal are input to turn on the data writing circuit 200 and the drive circuit 100, and the data writing circuit 200 writes the data signal to the first terminal 110 and the second terminal 120 of the drive circuit 100.

It should be noted that the detailed description of the driving method may refer to the description of the operation principle of the pixel circuit 10 in the embodiments of the present disclosure, and will not be repeated here.

The driving method provided by some embodiments of the present disclosure may realize low-frequency driving and improve the resolution of a display panel. Meanwhile, because a leakage current of an N-type transistor is small, there is no need to consider the aging problem of the N-type transistor in the use process.

For the present disclosure, the following statements should be noted:

(1) The accompanying drawings involve only the structure(s) in connection with the embodiment(s) of the present disclosure, and for other structure(s), reference can be made to common design(s).

(2) the embodiments of the present disclosure and features in the embodiments may be combined with each other to obtain new embodiments if they do not conflict with each other.

What are described above is related to the specific embodiments of the disclosure only and not limitative to the scope of the disclosure, and the scopes of the disclosure are defined by the accompanying claims.

What is claimed is:

1. A pixel circuit, comprising: a drive circuit, a data writing circuit, a compensation circuit, and a light emitting element, wherein the drive circuit includes a control terminal, a first terminal and a second terminal, and is configured to control a drive current flowing through the first terminal and the second terminal for driving the light emitting element to emit light;

the data writing circuit is connected to a first terminal of the drive circuit and configured to write a data signal to the first terminal of the drive circuit in response to a first scanning signal;

the compensation circuit is connected to a control terminal and a second terminal of the drive circuit and connected to a first voltage terminal, and is configured to store a data signal written by the data writing circuit and compensate the drive circuit in response to a second scanning signal; and the light emitting element includes a first terminal and a second terminal, and a first terminal of the light emitting element is configured to receive the drive current, and a second terminal of the light emitting element is connected to a second voltage terminal;

a first light emitting control circuit connected to the first terminal of the drive circuit and the first voltage terminal; and a second light emitting control circuit connected to the second terminal of the drive circuit and the first terminal of the light emitting element.

2. The pixel circuit according to claim 1, wherein the first light emitting control circuit is configured to apply a first voltage received from the first voltage terminal to the first terminal of the drive circuit in response to a first light emitting control signal.

3. The pixel circuit according to claim 2, wherein the first light emitting control circuit comprises a fourth transistor; and wherein a gate electrode of the fourth transistor is connected to a first light emitting control line for receiving the first light emitting control signal, a first electrode of the fourth transistor is connected to the first voltage terminal for receiving the first voltage, and a second electrode of the fourth transistor is connected to the first terminal of the drive circuit.

4. A method for driving the pixel circuit according to claim 2, comprising: a data writing and compensation stage and a light emitting stage, wherein in the data writing and compensation stage, the first scanning signal, the second scanning signal and the data signal are input to turn on the data writing circuit, the drive circuit and the compensation circuit, and the data writing circuit writes the data signal into the drive circuit, the compensation circuit stores the data signal, and the compensation circuit compensates the drive circuit; and in the light emitting stage, the first light emitting control signal is input so as to turn on the first light emitting control circuit and the drive circuit, and the first light emitting control circuit applies the drive current to the light emitting element so that the light emitting element emits light; and wherein the first scanning signal and the second scanning signal are simultaneously on-signals within at least part of the data writing and compensation stage and the light emitting stage.

5. The pixel circuit according to claim 2, wherein the second light emitting control circuit is configured to apply the drive current to the light emitting element in response to a second light emitting control signal.

6. The pixel circuit according to claim 5, wherein the second light emitting control circuit comprises a fifth transistor; and wherein a gate electrode of the fifth transistor is connected to a second light emitting control line for receiving the second light emitting control signal, a first electrode of the fifth transistor is connected to the second terminal of the drive circuit, and a second electrode of the fifth transistor is connected to the first terminal of the light emitting element.

7. The pixel circuit according to claim 5, further comprising a reset circuit, wherein the reset circuit is connected to a reset voltage terminal and the first terminal of the light emitting element, and is configured to apply a reset voltage received from the reset voltage terminal to the first terminal of the light emitting element in response to a reset signal; and wherein the reset signal is the second scanning signal.

8. The pixel circuit of claim 7, wherein the compensation circuit and the reset circuit each comprise an N-type transistor, and the drive circuit, the data writing circuit, the first light emitting control circuit, and the second light emitting control circuit each comprise a P-type transistor.

9. A method for driving the pixel circuit according to claim 7, comprising: an initialization stage, a data writing and compensation stage, a pre-light emitting stage and a light emitting stage;

wherein, in the initialization stage, the reset signal, the second scanning signal and the second light emitting control signal are input so as to turn on the reset circuit, the compensation circuit and the second light emitting control circuit, and the reset voltage is applied to the control terminal, the first terminal and the second terminal of the drive circuit and the first terminal of the light emitting element;

in the data writing and compensation stage, the first scanning signal, the second scanning signal and the data signal are input so as to turn on the data writing circuit, the drive circuit and the compensation circuit, and the data writing circuit writes the data signal into the drive circuit, the compensation circuit stores the data signal, and the compensation circuit compensates the drive circuit;

in the pre-light emitting stage, the first light emitting control signal is input so as to turn on the first light emitting control circuit and the drive circuit, and the first light emitting control circuit applies the first voltage to the first terminal of the drive circuit;

in the light emitting stage, the first light emitting control signal and the second light emitting control signal are input so as to turn on the first light emitting control circuit, the second light emitting control circuit and the drive circuit, and the second light emitting control circuit applies the drive current to the light emitting element so that the light emitting element emits light;

wherein the first scanning signal and the second scanning signal are simultaneously on signals within at least part of the initialization stage, the data writing and compensation stage, the pre-light emitting stage and the light emitting stage, and the first light emitting control signal and the second light emitting control signal are simultaneously on signals within at least part of the initialization stage, the data writing and compensation stage, the pre-light emitting stage and the light emitting stage.

10. The driving method of the pixel circuit according to claim 9, further comprising: a data write holding stage, wherein, in the data write holding stage, the first scanning signal is input so as to turn on the data writing circuit, and the second scanning signal is input so as to turn off the compensation circuit for holding a voltage at the control terminal of the drive circuit.

11. The pixel circuit of claim 7, wherein the reset circuit comprises a sixth transistor; and wherein a gate electrode of the sixth transistor is connected to a second scanning line for receiving the second scanning signal as the reset signal, a first electrode of the sixth transistor is connected to the reset voltage terminal for receiving the reset voltage, and a second electrode of the sixth transistor is connected to the first terminal of the light emitting element.

12. The pixel circuit according to claim 11, wherein the drive circuit comprises a first transistor, and a gate electrode of the first transistor serves as the control terminal of the drive circuit, a first electrode of the first transistor serves as the first terminal of the drive circuit, and a second electrode of the first transistor serves as the second terminal of the drive circuit;

the data writing circuit includes a second transistor, and a gate electrode of the second transistor is connected to a first scanning line for receiving the first scanning signal, a first electrode of the second transistor is connected to a data line for receiving the data signal, and a second electrode of the second transistor is connected to the first terminal of the drive circuit;

the compensation circuit comprises a third transistor and a capacitor, a gate electrode of the third transistor is connected to the second scanning line for receiving the second scanning signal, a first electrode of the third transistor is connected to the second terminal of the drive circuit, and a second electrode of the third transistor is connected to the control terminal of the drive circuit; and a first electrode of the capacitor is connected to the control terminal of the drive circuit, and a second electrode of the capacitor is connected to the first voltage terminal;

the first light emitting control circuit comprises a fourth transistor, a gate electrode of the fourth transistor is connected to a first light emitting control line for receiving the first light emitting control signal, a first electrode of the fourth transistor is connected to the first voltage terminal for receiving the first voltage, and a second electrode of the fourth transistor is connected to the first terminal of the drive circuit; and the second light emitting control circuit comprises a fifth transistor, a gate electrode of the fifth transistor is connected to a second light emitting control line for receiving the second light emitting control signal, a first electrode of the fifth transistor is connected to the second terminal of the drive circuit, and a second electrode of the fifth transistor is connected to the first terminal of the light emitting element.

13. The pixel circuit according to claim 12, wherein the third transistor and the sixth transistor are N-type transistors, and the first transistor, the second transistor, the fourth transistor and the fifth transistor are P-type transistors.

14. The pixel circuit according to claim 1, wherein the drive circuit comprises a first transistor; and wherein a gate electrode of the first transistor serves as the control terminal of the drive circuit, a first electrode of the first transistor serves as the first terminal of the drive circuit, and a second electrode of the first transistor serves as the second terminal of the drive circuit.

15. The pixel circuit according to claim 1, wherein the data writing circuit comprises a second transistor; and wherein a gate electrode of the second transistor is connected to a first scanning line for receiving the first scanning signal, a first electrode of the second transistor is connected to a data line for receiving the data signal, and a second electrode of the second transistor is connected to the first terminal of the drive circuit.

16. The pixel circuit according to claim 1, wherein the compensation circuit comprises a third transistor and a capacitor;

wherein a gate electrode of the third transistor is connected to a second scanning line for receiving the second scanning signal, a first electrode of the third transistor is connected to the second terminal of the drive circuit, and a second electrode of the third transistor is connected to the control terminal of the drive circuit; and wherein a first electrode of the capacitor is connected to the control terminal of the drive circuit, and a second electrode of the capacitor is connected to the first voltage terminal.

17. The pixel circuit according to claim 1, wherein a type of the transistor included in the compensation circuit is different from that of the transistor included in the drive circuit.

18. The pixel circuit according to claim 17, wherein the compensation circuit comprises an N-type transistor and the drive circuit comprises a P-type transistor.

19. A display panel, comprising a plurality of pixel units arranged in an array, wherein each of the plurality of pixel units comprises a pixel circuit, wherein the pixel circuit comprises:

a drive circuit, a data writing circuit, a compensation circuit, and a light emitting element, wherein the drive circuit includes a control terminal, a first terminal and a second terminal, and is configured to control a drive current flowing through the first terminal and the second terminal for driving the light emitting element to emit light;

the data writing circuit is connected to a first terminal of the drive circuit and configured to write a data signal to the first terminal of the drive circuit in response to a first scanning signal;

the compensation circuit is connected to a control terminal and a second terminal of the drive circuit and connected to a first voltage terminal, and is configured to store a data signal written by the data writing circuit and compensate the drive circuit in response to a second scanning signal; and the light emitting element includes a first terminal and a second terminal, and a first terminal of the light emitting element is configured to receive the drive current, and a second terminal of the light emitting element is connected to a second voltage terminal;

a first light emitting control circuit connected to the first terminal of the drive circuit and the first voltage terminal; and a second light emitting control circuit connected to the second terminal of the drive circuit and the first terminal of the light emitting element.

20. The display panel according to claim 19, further comprising a plurality of light emitting control lines, wherein the plurality of pixel units are arranged in a plurality of rows, and a second light emitting control circuit of a pixel circuit of pixel units in a $n^{th}$ row and a first light emitting control circuit of a pixel circuit of pixel units in a $n+1^{st}$ row are connected to a same light emitting control line, and wherein n is an integer greater than zero.

* * * * *